US006718704B2

(12) United States Patent
Plummer et al.

(10) Patent No.: US 6,718,704 B2
(45) Date of Patent: Apr. 13, 2004

(54) ATTACHMENT SYSTEM FOR A DECORATIVE MEMBER

(75) Inventors: David Plummer, Hudson, WI (US); Robert L. McMullen, Hudson, WI (US)

(73) Assignee: Andersen Corporation, Bayport, MN (US)

( * ) Notice: Subject to any disclaimer, the term of this patent is extended or adjusted under 35 U.S.C. 154(b) by 187 days.

(21) Appl. No.: 10/001,009

(22) Filed: Nov. 1, 2001

(65) Prior Publication Data

US 2002/0112422 A1 Aug. 22, 2002

Related U.S. Application Data

(60) Provisional application No. 60/244,862, filed on Nov. 1, 2000.

(51) Int. Cl.[7] ..... E06B 3/964

(52) U.S. Cl. ..... 52/204.61; 52/204.53; 52/204.6; 52/456; 52/636.5; 49/50; 49/57

(58) Field of Search ..... 52/204.61, 204.53, 52/204.6, 456, 656.5; 49/50, 57

(56) References Cited

U.S. PATENT DOCUMENTS

| | | | | |
|---|---|---|---|---|
| 3,108,336 A | | 10/1963 | Tate | |
| 3,221,462 A | | 12/1965 | Pomeroy | |
| 3,340,661 A | | 9/1967 | Krieger | |
| 3,358,412 A | | 12/1967 | Martin | |
| 3,372,522 A | | 3/1968 | Engstrom | |
| 3,381,431 A | | 5/1968 | Jacobson | |
| 3,411,258 A | | 11/1968 | Kessler | |
| 3,504,468 A | | 4/1970 | Martin | |
| 3,708,939 A | | 1/1973 | Herr | |
| 4,060,950 A | | 12/1977 | Rackard et al. | |
| 4,437,284 A | | 3/1984 | Cribben et al. | |
| 4,586,306 A | * | 5/1986 | Webb | 52/204.61 |
| 4,644,721 A | | 2/1987 | Bloomquist et al. | |
| 4,838,001 A | | 6/1989 | Battles | |
| 4,854,100 A | | 8/1989 | La See | |
| 4,890,435 A | | 1/1990 | Wilkening et al. | |
| 4,970,840 A | * | 11/1990 | Ouellette et al. | 52/204.61 |
| 5,048,252 A | | 9/1991 | Osborn | |
| 5,109,647 A | | 5/1992 | La See | |
| 5,174,091 A | | 12/1992 | Stokx | |
| 5,177,920 A | | 1/1993 | Rafeld | |
| 5,226,919 A | | 7/1993 | Milligan | |
| 5,274,976 A | | 1/1994 | Burkhart | |
| D350,064 S | | 8/1994 | Crawley | |
| 5,406,768 A | | 4/1995 | Giuseppe et al. | |
| 5,437,133 A | | 8/1995 | Pliml | |
| 5,456,048 A | | 10/1995 | White | |
| 5,836,119 A | | 11/1998 | Emmanuel | |
| D405,683 S | | 2/1999 | Opielski et al. | |
| D408,728 S | | 4/1999 | Opielski et al. | |
| 5,948,524 A | | 9/1999 | Seethamraju et al. | |
| 6,155,010 A | * | 12/2000 | Becken et al. | 52/204.61 |

* cited by examiner

*Primary Examiner*—Carl D. Friedman
*Assistant Examiner*—Steve M Varner
(74) *Attorney, Agent, or Firm*—Womble Carlyle Sandridge & Rice, PLLC

(57) ABSTRACT

A fenestration system including a glass unit, attachment member and decorative member is provided. The decorative member includes a rotatable coupler for easy attachment of the decorative member to the attachment member. An attachment system including a decorative member having a rotatable coupler is also provided. A rotatable coupler is also provided.

21 Claims, 9 Drawing Sheets

FIG. 3
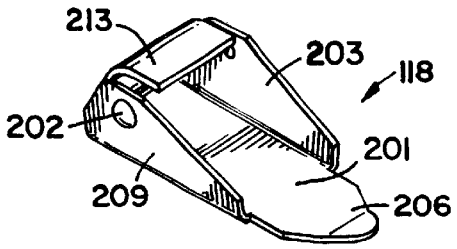
FIG. 4
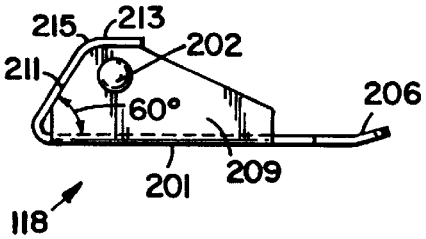
FIG. 5
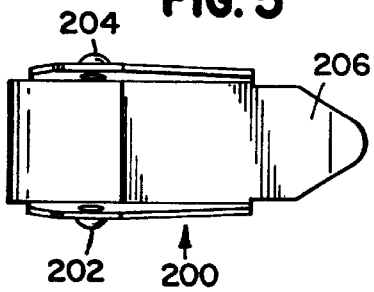
FIG. 6
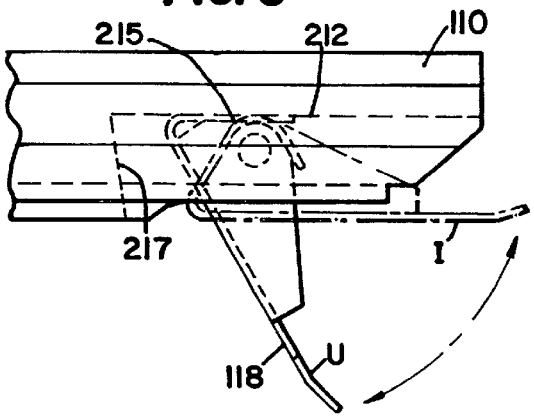
FIG. 7
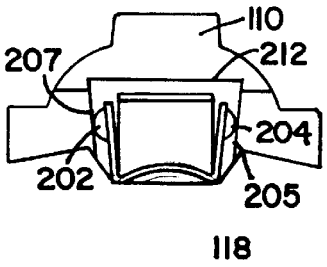
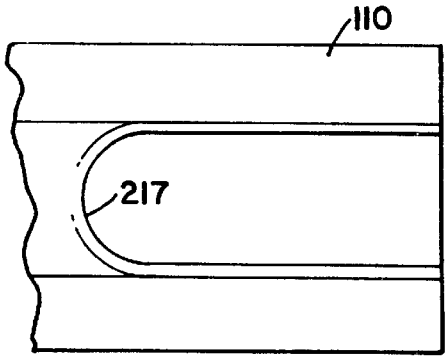
FIG. 8

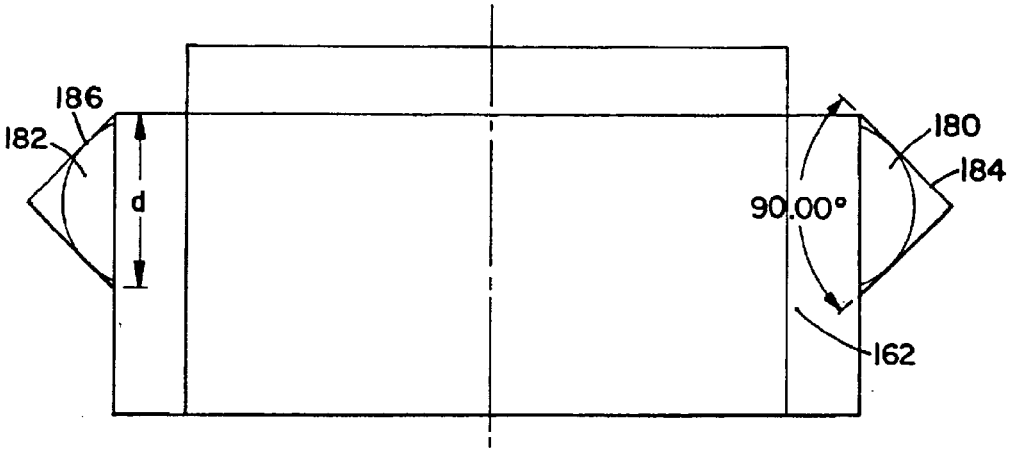
FIG. 16
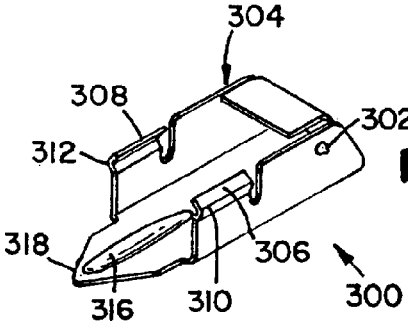
FIG. 17
FIG. 18
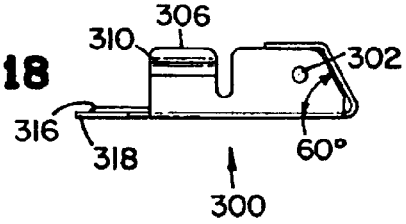
FIG.19
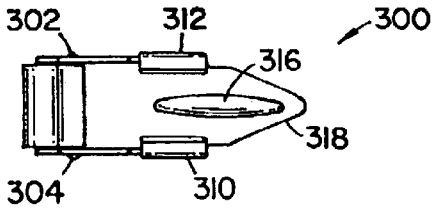

ATTACHMENT SYSTEM FOR A DECORATIVE MEMBER

PRIORITY

This application claims priority to application Ser. No. 60/244,862, filed Nov. 1, 2000, which application is herein incorporated by reference.

FIELD OF THE INVENTION

The present invention generally relates to a rotatable coupler for attaching a decorative member to an attachment member such as a frame, sash or glass unit.

BACKGROUND OF THE INVENTION

Decorative members such as grilles are used to add style and character to single-paned windows. The grilles are added to create a multi-paned look. The grilles are more frequently attached to the window or door on the interior side of the glass unit.

With traditional grille clips it is often difficult to place the grille on the window. The grille clips must first be attached to the window by placing tips into a slot between the glass and the frame. Then the grille is very carefully placed onto the grille clips.

U.S. Pat. No. 4,644,721 (Bloomquist et al.), which is incorporated herein by reference, discloses a grille clip that provides the interface between a window and the grille. The grille clip in Bloomquist et al. is positioned in the end of a grille. The grille clip in Bloomquist includes tips that extend out beyond the end of the grille. The tips are inserted between the glass and the inside portion of the window frame.

U.S. Pat. No. 4,890,435 (Wilkening et al.), which is incorporated herein by reference, discloses another type of grille clip that is fastened to the grille.

BRIEF DESCRIPTION OF THE DRAWINGS

FIG. 3 is a perspective view of a rotatable grille clip of one embodiment of the present invention.

FIG. 4 is a side view of a rotatable grille clip of one embodiment of the present invention.

FIG. 5 is a top view of a rotatable grille clip of one embodiment of the present invention.

FIG. 6 is a side view of a rotatable grille clip of one embodiment of the present invention positioned in an installation end of a grille with the clip shown in both installed and uninstalled positions.

FIG. 7 is a cross sectional view of one embodiment of an installation end of a grille with a rotatable grille clip positioned in its installed position.

FIG. 8 is a bottom view of one embodiment of an installation end of a grille.

FIG. 16 is a partial cross sectional view of a rotatable grille clip and its interaction with kerfs in an installation end of a grille.

FIG. 17 is a perspective view of one embodiment of a rotatable grille clip of the present invention.

FIG. 18 is a side view of the rotatable grille clip shown in FIG. 17.

FIG. 19 is a top view of the rotatable grille clip shown in FIGS. 17 and 18.

DETAILED DESCRIPTION OF THE PREFERRED EMBODIMENT

The following definitions are to be utilized for purposes of this application.

A "fenestration unit" is a device for filling a hole or other opening in a wall, roof or other surface of a structure, including, but not limited to windows and doors.

A "glass unit" is any piece of glass utilized in a fenestration unit. A glass unit can include, but is not limited to, a single pane of glass, or an insulated glass unit including multiple panes of glass separated by spacers.

An "attachment member" is any device secured to a substantially planar member such as, but not limited to, a glass unit, picture, mirror, wherein the attachment member is configured for connecting with a decorative member. An attachment member may be, but is not limited to, a sash, frame, trim strip attached to a sash, trim strip attached to a frame, and trim strip attached directly to a glass unit.

A "decorative member" is any piece or member that is substantially coplanar with an engagement piece of a rotatable coupler when the decorative member and the rotatable coupler are in their installed positions. A decorative member may be adjacent to a planar member such as, but not limited to, a window, door, picture in a picture frame or mirror. However, a decorative member does not necessarily have to be adjacent to a planar member such as in the case of use of a decorative member as an insert for a room divider. A decorative member may be, but is not limited to, a muntin, or a grille.

A "rotatable coupler" is a member or piece of hardware that may be integral with or engageable with a decorative member, the rotatable coupler having an engagement piece and a pivot point wherein the engagement piece may be pivoted relative to the decorative member.

An "engagement piece" is any point capable of matingly interacting with an attachment member. An engagement piece may be, but is not limited to, a tab of various shapes and sizes.

Figure 1:
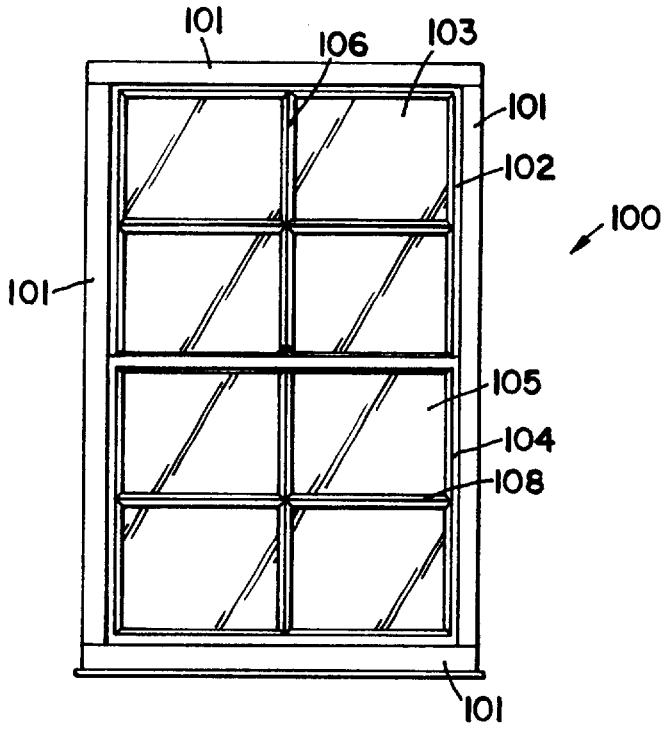
FIG. 1 is a front view of a window in accordance with one embodiment of the present invention.

FIG. 1 illustrates a double-hung window 100, pursuant to one embodiment of the present invention, including a frame 101, an upper sash 102 and a lower sash 104. The upper sash 102 encloses a glass unit 103 and the lower sash 104 encloses a glass unit 105. Grille 106 is attached to the upper sash 102 and grille 108 is attached to the lower sash 104. Note that the grille typically is attached to the interior of the glass unit. The interior of the glass unit is the surface on the inside of the home or other structure.

Figure 2:
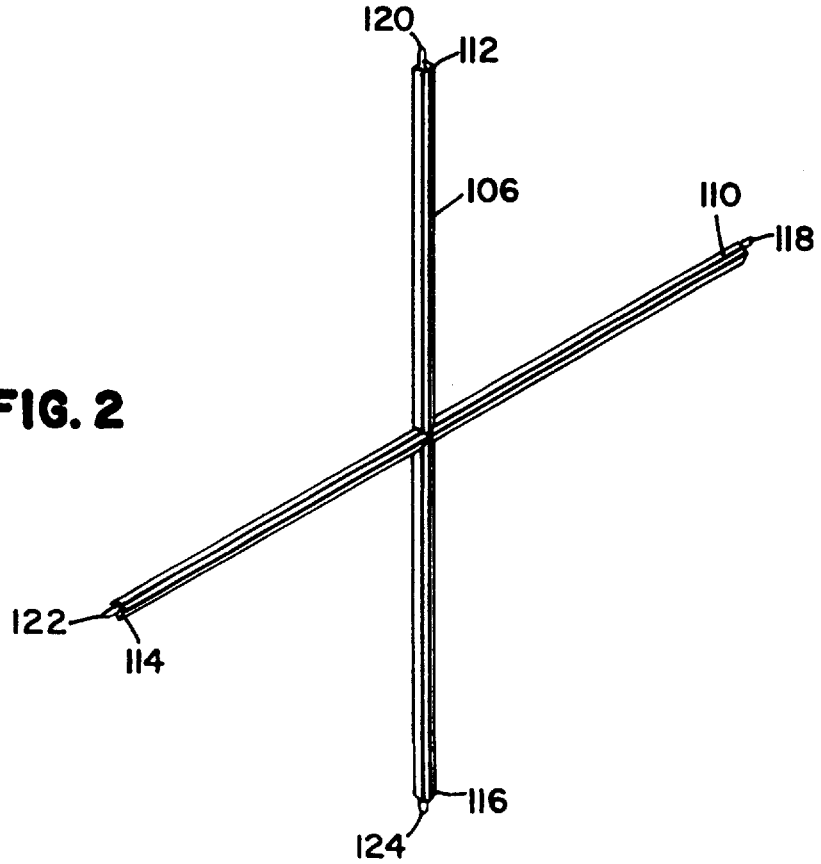
FIG. 2 is a perspective view of a grille in accordance with one embodiment of the present invention.

FIG. 2 illustrates a grille 106 according to one embodiment of the present invention. Grille 106 includes four installation ends 110, 112, 114, and 116. Grille 106 also includes rotatable grille clips 118, 120, 122, and 124 respectively. The view of FIG. 2 is the view that would be seen from the interior of the house or structure and looking towards a window unit in which the grille would be installed.

FIGS. 3–5 illustrate perspective, side and top views of rotatable grille clip 118 which is one possible embodiment of a rotatable coupler.

Rotatable grille clip 118 is a folded body of spring steel. The body includes a bottom surface 201, side walls 203 and 208, angled back 211 and top 213. The side walls 203 and 208 and the angled back 211 are folded attachments to the bottom surface 201. The top 213 is attached to the angled back 211 along camming edge 215. The rotatable grille clip 118 is made out of a single piece of spring steel. Rotatable grille clip 118 includes pivot projections 202 and 204, which provide an axis around which the rotatable grille clip 118 pivots or rotates.

The angle between the angled back 211 and the bottom surface 201 is 60 degrees. However, it is important to note that the angle between angled back 211 and bottom surface 201 could be any angle of at least about 30 degrees.

FIG. 5 illustrates a top view of rotatable grille clip 118. Rotatable grille clip 118 includes engagement tab 206, which is one embodiment of an engagement piece.

A rotatable coupler has an installed or closed position, which is the position that the coupler is in when the decorative member within which it is attached is installed to a glass unit. A rotatable coupler also has an uninstalled or open position, which is the position that the coupler is in when the decorative member within which it is attached is not installed to a glass unit.

FIG. 6 illustrates the interaction of the clip 118 with an installation end 110 of grille 106. Clip 118 is shown in an uninstalled or open position designated with a "U" and also in an installed or closed position designated with a "I". Clip 118 rotates about the axis that extends between the projections 202 and 204.

FIG. 7 is a cross-sectional view of one embodiment of an installation end 110 of grille 106. The installation end 110 of the grille is milled to create a recessed cavity 212 made up of side walls 205 and 207 and inner surface 212. Clip 118 is situated in the recessed cavity 212. The pivot projections 204 and 202 make contact with the side walls 205 and 207 respectively to provide a point of rotation between the installation end 110 and the clip 118.

As can be seen in FIG. 6, as the clip 118 moves from the uninstalled position to the installed position, the bent portion 215 of the clip situated between the top 213 and the angled back 211 provides an edge that is pressed into the inner surface 212 of the installation end 110. Movement of this bent portion or edge 215 against the inner surface 212 along with the spring effect of the angled back 211 and top 213 relative to the bottom surface 201, results in a snap effect in which the clip 118 snaps or makes a cam like transition from the uninstalled position to the installed position. This bent portion or edge 215 provides a spring like barrier that prevents the clip 118 from toggling between uninstalled and installed positions.

FIG. 8 illustrates a bottom view of the installation end 110 of grille 106. This bottom view is the view as seen from the glass when the grille is in the installed position.

Figure 9:
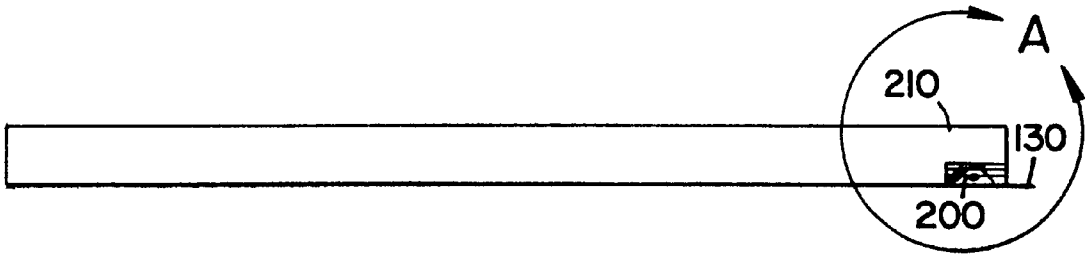
FIG. 9 is a side view of one installation end of a grille in accordance with one embodiment of the present invention.

FIGS. 9–12 illustrate various positions of another embodiment of a rotatable coupler, specifically rotatable grille clip 200. FIG. 9 illustrates an end 210 of a grille 250. Rotatable grille clip 200 includes one embodiment of an engagement piece, namely, tab 130. The rotatable grille clip 200 is shown in its installed position in FIG. 9 and in its uninstalled position in FIG. 11.

Figure 10:
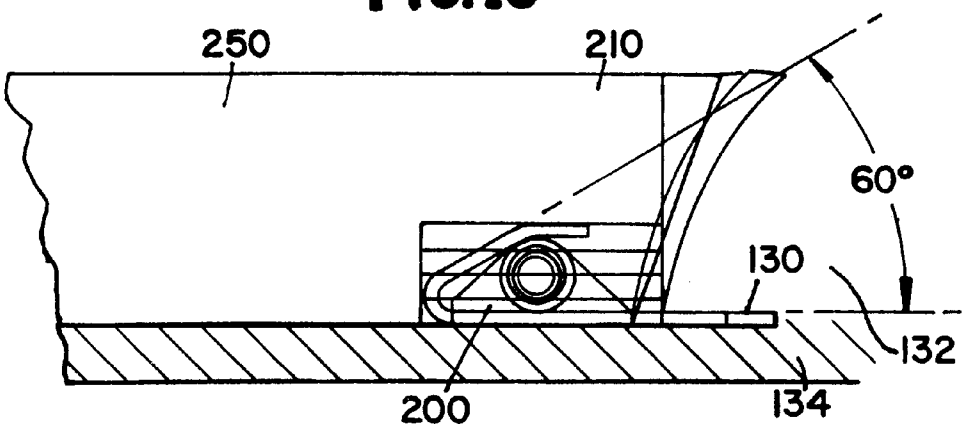
FIG. 10 is a closer side view of one installation end of a grille in accordance with one embodiment of the present invention with a rotatable grille clip in an installed position.

FIG. 10 is a closer view of end 210 of the embodiment shown in FIG. 9. Member 132 is a general characterization of a possible attachment member. The member 132 could be any type of attachment member including a trim strip attached to a sash or a trim strip attached directly to a glass unit. Furthermore, member 132 could be the sash itself or the frame itself. Tab 130 of the rotatable grille clip 200 can be seen in its installed position between a glass unit 134 and the member 132. In the installed position it can be seen that the positioning of the tab 130 between the glass unit 134 and the member 132 prevents the end 210 of the grille 250 from lifting away from the surface of the glass unit 134.

Figure 11:
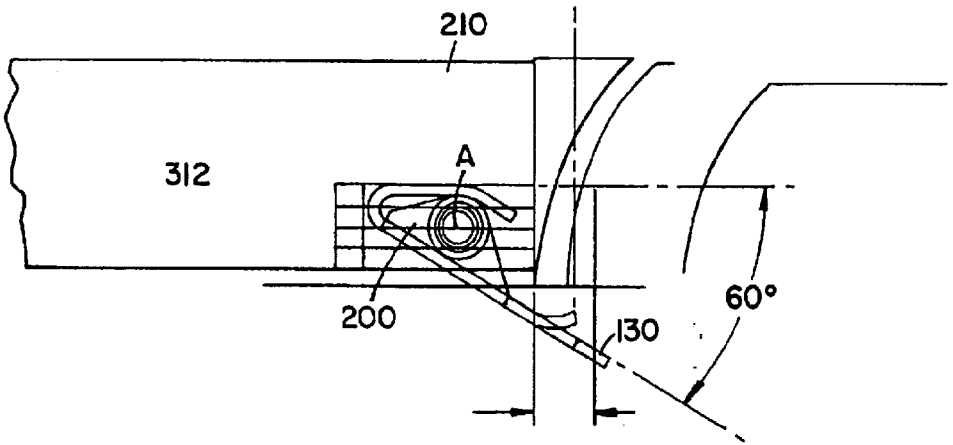
FIG. 11 is a side view of one installation end of a grille in accordance with one embodiment of the present invention with a rotatable grille clip in an uninstalled position.
Figure 12:
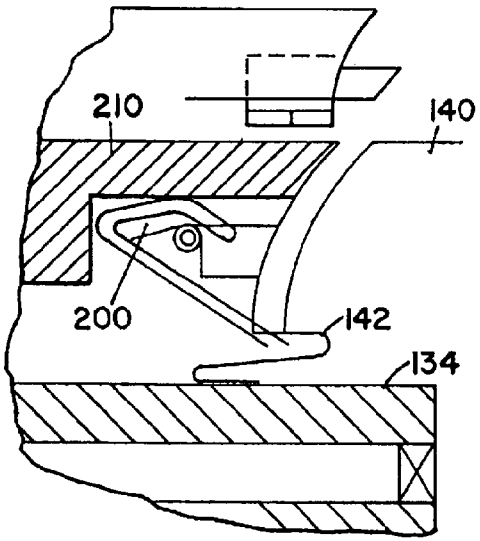
FIG. 12 is a side view of one installation end of a grille and an attachment member in accordance with one embodiment of the present invention with a rotatable grille clip positioned between an uninstalled and an installed position.

FIGS. 11–12 illustrate two possible positions of the clip 200 in conjunction with another embodiment of an attachment member, specifically member 140. The uninstalled position of rotatable grille clip 200 is shown in FIG. 11. In the position shown in FIG. 11, installation end 210 is not yet pressed down into a position adjacent to glass unit 134. As installation end 210 is pressed down onto glass panel 134, tab 130 makes contact with the glass panel 134. As the glass panel 134 and the installation end 210 of the decorative member are pressed into a position immediately adjacent each other, the rotatable grille clip 200 rotates about axis A such that the rotatable grille clip 200 snaps into the installed position.

FIG. 12 illustrates the rotatable grille clip 200 partially rotated from its uninstalled position as shown in FIG. 11 to its installed position as shown in FIG. 10. Member 140 defines a groove 142 for receipt of the tab 130.

FIGS. 13, 14*a*, 14*b* and 15 illustrate another embodiment of an attachment member, specifically member 150, in conjunction with an installation end 152 of a grille. It is noted that FIGS. 13, 14*a*, 14*b* and 15 are not necessarily drawn to scale. Member 150 may be a trim strip that is attached to a sash or a frame. For example, member 150 could be attached to a sash by a snap fit enveloping barb 158. Alternatively, member 150 could be adhesively secured to a glass unit. For example, the member 150 could be a viscoelastic material that is adhesively secured to the glass by a silicone adhesive such as available from Dow Corning or General Electric. Member 150 includes a receptacle end 154 that defines a generally v-shaped receptacle 156. As the installation end 152 of the grille is pressed down onto the surface of the glass, the tab 160 of the rotatable grille clip 162 is received by the receptacle 156.

Figure 13:
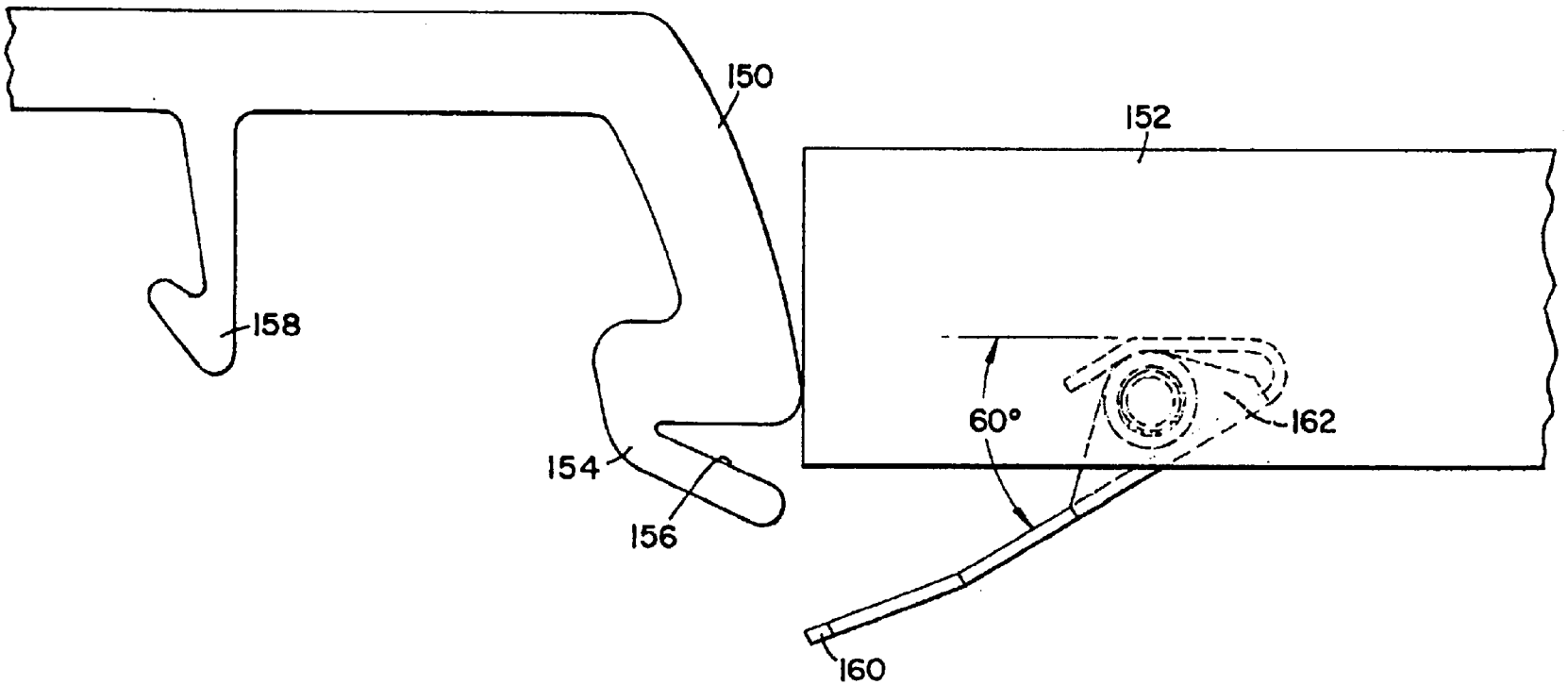
FIG. 13 is a side view of one embodiment of an attachment member and one installation end of a grille with a rotatable grille clip in its uninstalled position.

FIG. 13 illustrates the clip 162 in its uninstalled position.

Figure 14A:
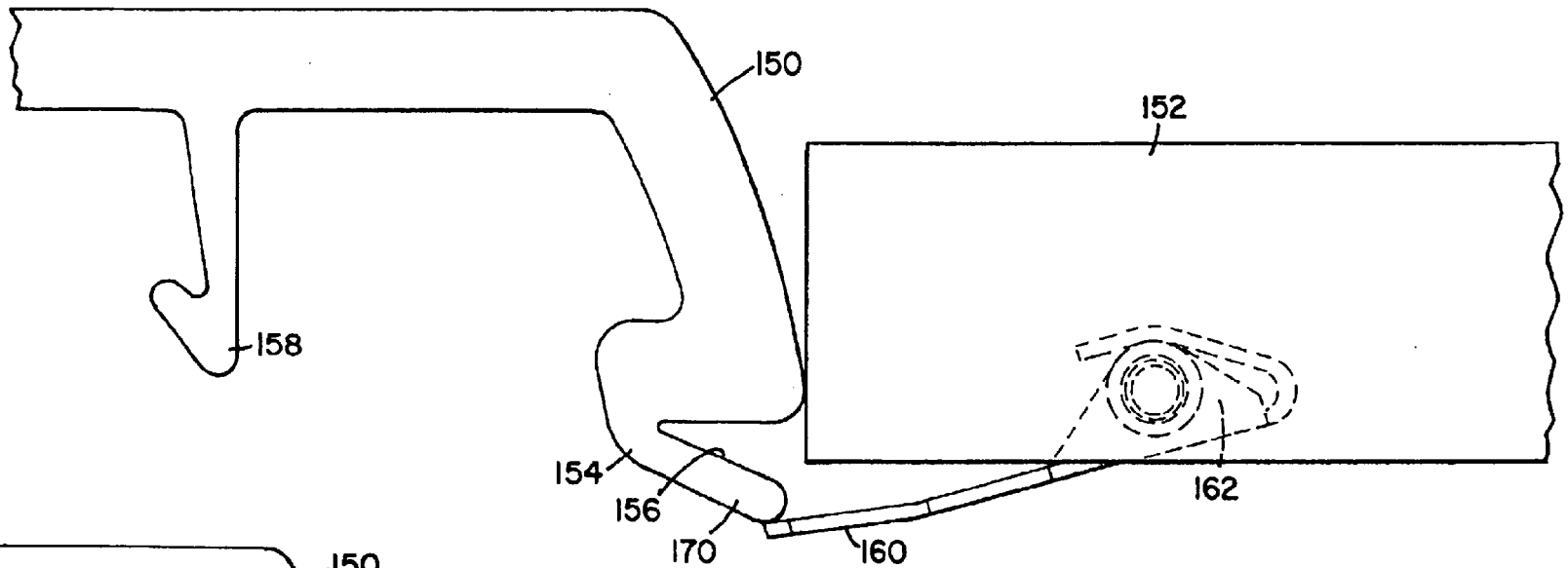
FIG. 14*a* is a side view of the embodiment of FIG. 13 with a rotatable grille clip in a position intermediate the uninstalled and installed positions.

FIG. 14*a* is the embodiment of FIG. 13 wherein the clip 162 is positioned intermediate the uninstalled and installed positions.

Figure 14B:
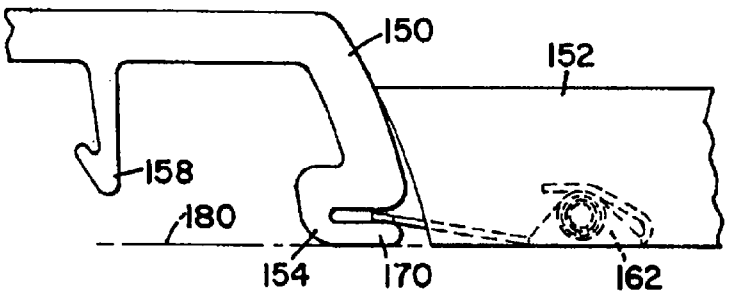
FIG. 14*b* is a side view of the embodiment of FIGS. 13 and 14*a* with a rotatable grille clip in an installed position including partial view of a glass unit.

FIG. 14*b* is the embodiment of FIG. 13 and 14*a* with the clip in its installed position adjacent a glass panel. It can be seen in FIG. 14*b* that the arm 170 of the receptacle 156 of the member 150 may be flexed in a direction away from the glass 180 when in the installed position.

Figure 15:
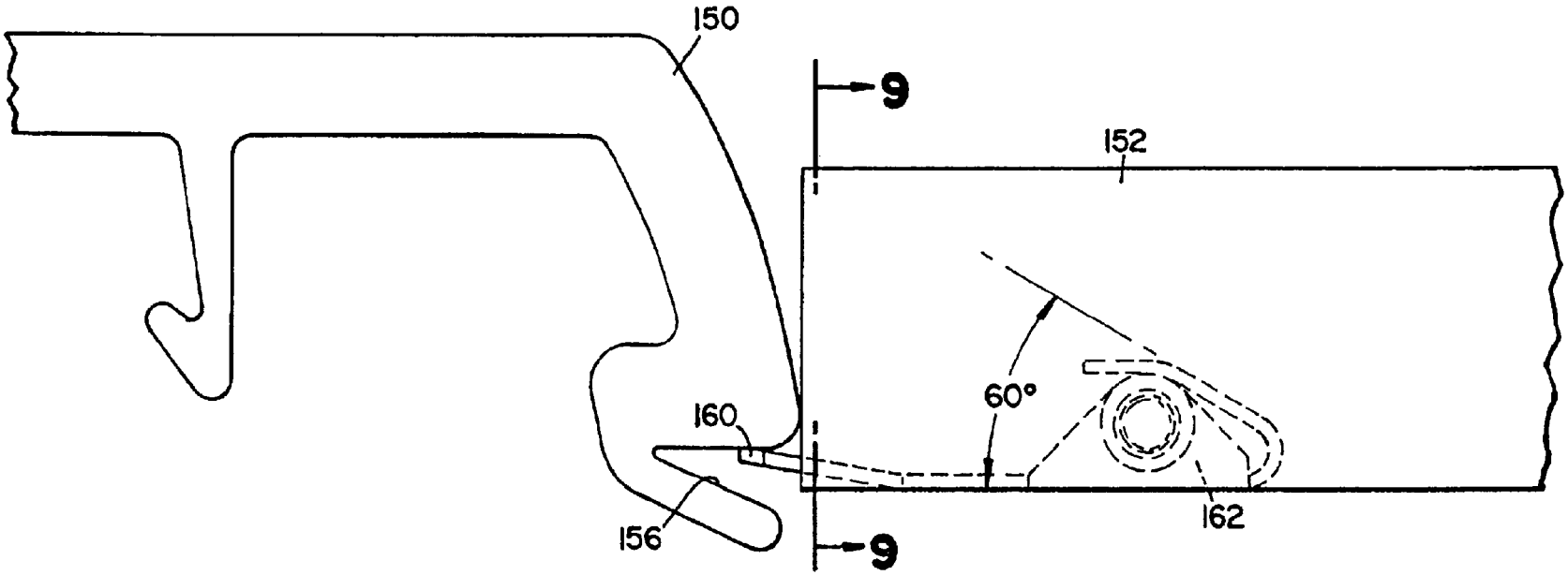
FIG. 15 is a side view of one embodiment of an attachment member and one end of a grille with a rotatable grille clip in its installed position.

FIG. 15 is the embodiment shown in FIGS. 13 and 14*a* with the rotatable grille clip in the installed position.

Many different shapes may be milled into the installation end of a decorative member for receipt of the rotatable coupler. One such shape was described above in conjunction with FIGS. 7 and 8. FIG. 16 illustrates another possible milled shape in an installation end. FIG. 16 is a cross-sectional view taken along lines 9–9 from FIG. 15. FIG. 16 shows the interaction of the projections 180 and 182 on the clip 162. In this embodiment, the installation end 152 is milled with kerfs 184 and 186 to receive the projections 180 and 182 respectively. The kerfs 184 and 186 vertically position the rotatable grille clip 162, aid in inserting the clip 162 into the installation end 152 of the grille and assist in preventing the clip 162 from sliding out of engagement with the installation end 152 of the grille.

FIG. 17 is a perspective view of another embodiment of a rotatable grille clip pursuant to the principles of the present invention. Rotatable grille clip 300 includes projection 302 and a projection 304 on the opposite side of the clip from projection 302. Clip 300 rotates along the axis formed by projections 302 and 304, similarly to the embodiment shown in FIGS. 3–8. Clip 300 includes tabs 306 and 308 which assist in locking the clip into place when the clip in the installed position. The ridges 310 and 312 on the tabs 306 and 308 press into the inner walls of the installation end of the grille. For example, if the installation end 110 of FIG. 7 was utilized in conjunction with clip 300, the ridges 310 and 312 would press against the inner side walls 205 and 207 of the installation end 110. The ridges 310 and 312 therefore hold the clip 300 in its installed position more securely upon insertion in the cavity 350 of an installation end 110.

It may be desirable to include an emboss in the design of any of the embodiments of the present invention. An emboss is a raised portion along the bottom surface of a clip. The purpose of the emboss is to strengthen the bottom surface of the clip, especially near the engagement piece. It is possible that without an emboss, the engagement piece may bend upon flexing during rotation of the grille clip from an uninstalled position to an installed position.

Figure 20:
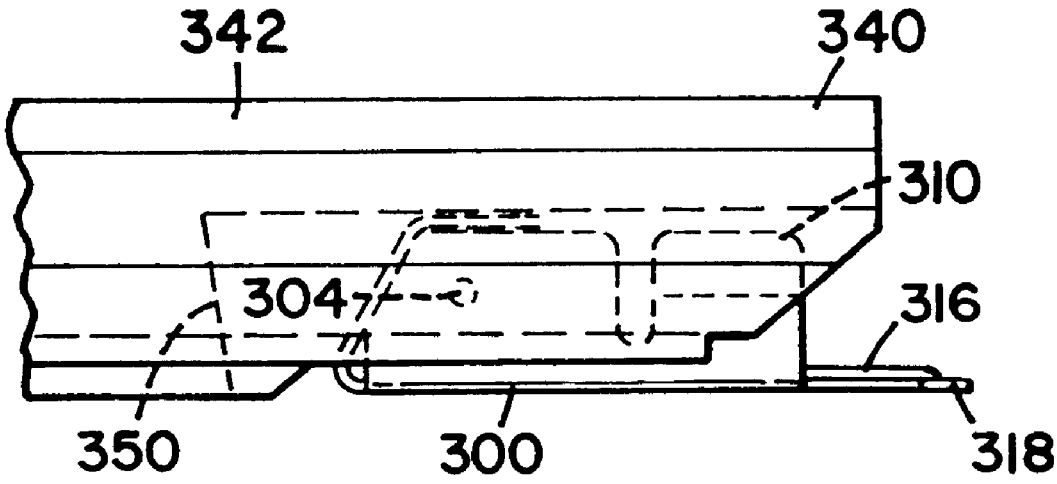
FIG. 20 is a side view of a rotatable grille clip in its installed position in an installation end of a grille in accordance with the present invention.

One example of an emboss is shown in FIG. 17 as emboss 316. Emboss 316 is generally oval-shaped and extends substantially to the end of the engagement tab 318. FIG. 18 is a side view of clip 300. FIG. 19 is a top view of clip 300. FIG. 20 is a side view of the rotatable grille clip 300 in its installed position in an installation end 340 of a grille 342.

The installation end of a grille pursuant to the principles of the present invention can be made of many different kinds of material including various woods, polymeric materials and also thermoplastic wood fiber composite materials such as those disclosed in U.S. Pat. Nos. 5,406,768 and 5,948,524, which are herein incorporated by reference.

In one preferred embodiment of the present invention, maple, oak or other hard woods are utilized to form the grille. Hard woods generally accommodate the stresses transmitted through the pivot projections that engage the kerfs (or in the absence of kerfs, the side walls of the cavity in the decorative member) during rotation of the grille clip.

Soft woods may also be utilized for the grille and it may be necessary to adjust the geometry of the rotatable coupler to accommodate softer materials by distributing the stresses over a larger pivot bearing surface during rotation of the grille clip. For example, if the rotatable coupler is a rotatable grille clip that includes projections 180 and 182, it may be necessary to modify the projections to a larger diameter d if softer materials are selected to be used for the grille.

It should be noted that while the above-recited embodiments of the present invention have been disclosed in terms of attaching a decorative member to a glass unit, it is also within the scope of the present invention to utilize the disclosed rotatable grille clips and rotatable couplers in general to attach decorative members to other substantially planar surfaces. For example, it may be desirable to insert a decorative member within a recess of a door that has no glass unit. One skilled in the art can see that this invention could be useful in attaching such a decorative member. Another example of using the present invention in conjunction with something other than a glass unit, one could envision use of the rotatable clips of the present invention to attach a decorative member to a picture frame or a frame for a painting or other print. These examples are given as mere examples and many other embodiments and uses of the present invention can be contemplated and are considered to be within the scope of the present invention.

The foregoing description of various embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

We claim:

1. A fenestration system comprising:

(a) a glass unit;

(b) an attachment member secured to the glass unit, the attachment member at least partially defining at least one receptacle capable of receiving an engagement piece of a rotatable coupler; and (c) a decorative member having at least one installation end, said decorative member adapted for installation adjacent the glass unit, wherein the at least one installation end has a rotatable coupler, the rotatable coupler comprising an engagement piece, the rotatable coupler having an uninstalled position and an installed position, wherein the engagement piece extends into the receptacle and is substantially parallel to the plane of the surface of the glass unit when in the installed position, and wherein the engagement piece departs from the installed position by at least 30 degrees when the rotatable coupler is in the uninstalled position.

2. The system of claim 1 wherein the decorative member comprises a grill comprising two linear members at a fixed perpendicular position, each linear member having at least one installation end.

3. The system of claim 1 wherein the decorative member comprises a muntin having a first installation end and a second installation end.

4. The system of claim 1 wherein the rotatable coupler comprises an axis about which the rotatable coupler rotates.

5. The system of claim 1 wherein the rotatable coupler is a separate piece from the decorative member and is mounted within a recess formed in the installation end of the decorative member.

6. The system of claim 1 wherein the rotatable coupler comprises a spring loaded member biasing the rotatable coupler in the uninstalled position.

7. The system of claim 1 wherein the receptacle is formed between the glass unit and the attachment member.

8. The system of claim 1 wherein the engagement piece of the rotatable coupler departs from the plane of the glass unit by between about 30 and 75 degrees when in its uninstalled position.

9. The system of claim 1 wherein the decorative member comprises a wooden profile.

10. The system of claim 1 wherein the profile comprises a thermoplastic composite profile.

11. An attachment system for attaching a decorative member adjacent a substantially planar surface, the attachment system comprising: a decorative member having at least one installation end, said decorative member adapted for installation on the substantially planar surface, wherein the installation end has a rotatable coupler, the rotatable coupler comprising an engagement piece, the rotatable coupler having an uninstalled position and an installed position, wherein the angle between the engagement piece in the installed and uninstalled positions is between about 30 and 75 degrees.

12. The attachment system according to claim 11 wherein the rotatable member is removably coupled to the decorative member.

13. The system of claim 12 wherein the rotatable coupler is mounted within a recess formed in the installation end of the decorative member.

14. The system of claim 11 wherein the decorative member comprises a grill comprising two linear members at a fixed perpendicular position, each linear member having at least one installation end.

15. The system of claim 11 wherein the decorative member comprises a muntin having a first installation end and a second installation end.

16. The system of claim 11 wherein the rotatable coupler comprises an axis about which the rotatable coupler rotates.

17. The system of claim 11 wherein the rotatable coupler comprises a spring loaded member maintaining the rotatable coupler in the uninstalled position.

18. The system of claim 11 wherein the engagement piece of the rotatable coupler departs from the plane of the glass unit by between about 30 and 75 degrees when in its uninstalled position.

19. A rotatable coupler for connecting a decorative member to an attachment member, the rotatable coupler comprising an arcuate camming surface, pivot projections aligned on the axis of rotation of the camming surface, and an engagement piece opposite the arcuate camming surface.

20. The rotatable coupler of claim 19 wherein the pivot projections are hemispherical.

21. The rotatable coupler of claim 19 further comprising an emboss.

* * * * *